US010923010B2

(12) United States Patent
Kim et al.

(10) Patent No.: US 10,923,010 B2
(45) Date of Patent: Feb. 16, 2021

(54) DISPLAY DEVICE

(71) Applicant: Samsung Display Co., Ltd., Yongin-si (KR)

(72) Inventors: Won Tae Kim, Yongin-si (KR); Kyung Bae Kim, Yongin-si (KR); Ji Ye Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/601,469

(22) Filed: Oct. 14, 2019

(65) Prior Publication Data

US 2020/0265764 A1 Aug. 20, 2020

(30) Foreign Application Priority Data

Feb. 19, 2019 (KR) ..... 10-2019-0019410

(51) Int. Cl.
*G09G 3/20* (2006.01)

(52) U.S. Cl.
CPC ..... *G09G 3/20* (2013.01); *G09G 2310/0213* (2013.01); *G09G 2310/0221* (2013.01); *G09G 2310/0267* (2013.01); *G09G 2310/0275* (2013.01); *G09G 2310/08* (2013.01)

(58) Field of Classification Search
CPC ..... H01L 27/124; H01L 27/3276; G09G 2300/0426; G09G 2300/0408; G09G 2310/0281
See application file for complete search history.

(56) References Cited

U.S. PATENT DOCUMENTS

2016/0181349 A1* 6/2016 Cho ..... H01L 27/3279 257/40
2017/0323611 A1 11/2017 Jo et al.
2019/0051668 A1* 2/2019 Huang ..... H01L 27/124

FOREIGN PATENT DOCUMENTS

KR 10-2017-0126568 A 11/2017

* cited by examiner

*Primary Examiner* — Gerald Johnson
(74) *Attorney, Agent, or Firm* — Lewis Roca Rothgerber Christie LLP

(57) ABSTRACT

A display device includes a display panel including a first display region in which a plurality of first data lines are positioned and a second display region adjacent to the first display region in which a plurality of second data lines are positioned, a first data driver and a second data driver in a non-display region of the display panel, a plurality of first fan-out lines connected to the first data driver and including a plurality of 1_1-th fan-out lines connected to the plurality of first data lines and a plurality of 1_2-th fan-out lines connected to the plurality of second data lines, and a plurality of second fan-out lines connected to the second data driver and including a plurality of 2_1-th fan-out lines connected to the plurality of second data lines and a plurality of 2_2-th fan-out lines connected to the plurality of first data lines.

14 Claims, 6 Drawing Sheets

DISPLAY DEVICE

CROSS-REFERENCE TO RELATED APPLICATION

This application claims priority to and the benefit of Korean Patent Application No. 10-2019-0019410, filed in the Korean Intellectual Property Office on Feb. 19, 2019, the entire content of which is incorporated herein by reference.

BACKGROUND

1. Field

Aspects of the present invention relates to a display device.

2. Description of the Related Art

As information technology is advancing, importance of display devices, which are connection media between users and information, has been highlighted. Therefore, display devices such as liquid crystal display devices, organic light emitting diode display devices, and plasma display devices have been increasingly used.

The display device includes data lines for transmitting data signals to a plurality of pixels and a data driver for generating the data signals. The plurality of data drivers may be disposed, and each of the data drivers may be connected to the data lines through fan-out lines disposed in a non-display region.

SUMMARY

Aspects of embodiment of the present invention are directed to a display device that includes a plurality of data drivers, and improves a phenomenon that a boundary line between display regions is visible since data lines disposed adjacent to the boundary line between two adjacent display regions can alternately receive data signals applied from different data drivers.

According to some embodiments of the present invention, there is provided a display device including: a display panel including a first display region in which a plurality of first data lines are positioned and a second display region in which a plurality of second data lines are positioned, the second display region being adjacent to the first display region; a first data driver and a second data driver in a non-display region of the display panel; a plurality of first fan-out lines connected to the first data driver and including a plurality of 1_1-th fan-out lines connected to the plurality of first data lines and a plurality of 1_2-th fan-out lines connected to the plurality of second data lines; and a plurality of second fan-out lines connected to the second data driver and including a plurality of 2_1-th fan-out lines connected to the plurality of second data lines and a plurality of 2_2-th fan-out lines connected to the plurality of first data lines.

In some embodiments, the non-display region includes a first fan-out region between the first data driver and the first display region, and a second fan-out region between the second data driver and the second display region, the plurality of 1_2-th fan-out lines are alongside a boundary line between the first fan-out region and the second fan-out region, and the plurality of 2_2-th fan-out lines are alongside the boundary line.

In some embodiments, the plurality of 1_2-th fan-out lines extend from the first fan-out region to the second fan-out region, and the plurality of 2_2-th fan-out lines extend from the second fan-out region to the first fan-out region.

In some embodiments, the plurality of 1_2-th fan-out lines are overlapped and crossed with some of the plurality of 1_1-th fan-out lines with an insulation layer interposed therebetween in the first fan-out region, and are overlapped and crossed with some of the plurality of 2_1-th fan-out lines with the insulation layer interposed therebetween in the second fan-out region, and the plurality of 1_2-th fan-out lines are overlapped and crossed with some of the plurality of 2_1-th fan-out lines with the insulation layer interposed therebetween in the second fan-out region, and are overlapped and crossed with some of the plurality of 1_1-th fan-out lines with the insulation layer interposed therebetween in the first fan-out region.

In some embodiments, the plurality of 1_2-th fan-out lines and the plurality of 2_2-th fan-out lines are alongside the boundary line between the first fan-out region and the second fan-out region and are overlapped and crossed with each other with the insulation layer interposed therebetween.

In some embodiments, the plurality of 1_2-th fan-out lines are adjacent to each other in groups of two or more or singularly provided, and the plurality of 2_2-th fan-out lines are adjacent to each other in groups of two or more or singularly provided.

In some embodiments, the plurality of 1_2-th fan-out lines are even-numbered or odd-numbered lines of the plurality of first fan-out lines, and the plurality of 2_2-th fan-out lines are even-numbered or odd-numbered lines of the plurality of second fan-out lines.

In some embodiments, the plurality of 1_2-th fan-out lines are all adjacent to each other, and the plurality of 2_2-th fan-out lines are all adjacent to each other.

In some embodiments, the plurality of 1_1-th fan-out lines are on different layers with the plurality of 1_2-th fan-out lines, and the plurality of 2_1-th fan-out lines are on different layers with the plurality of 2_2-th fan-out lines.

In some embodiments, the second data lines connected to the plurality of 1_2-th fan-out lines and the first data lines connected to the plurality of 2_2-th fan-out lines are alongside a boundary line between the first display region and the second display region.

In some embodiments, the first data lines, except for ones of the first data lines adjacent to the boundary line of the plurality of first data lines, are connected only to the plurality of 1_1-th fan-out lines and not the plurality of 2_2-th fan-out lines, and the second data lines, except for ones of the second data lines adjacent to the boundary line of the plurality of second data lines, are connected only to the plurality of 2_1-th fan-out lines and not the plurality of 1_2-th fan-out lines.

In some embodiments, the second data lines connected to the plurality of 1_2-th fan-out lines are odd-numbered or even-numbered lines of the plurality of second data lines, and the first data lines connected to the plurality of 2_2 fan-out lines are odd-numbered or even-numbered lines of the plurality of first data lines.

In some embodiments, second data lines connected to the plurality of 1_2-th fan-out lines and second data lines connected to the plurality of 2_1-th fan-out lines are alternately arranged in groups of two or more or singularly provided on a plan view, and first data lines connected to the plurality of 2_2-th fan-out lines and first data lines connected to the plurality of 1_1-th fan-out lines are alternatively arranged in groups of two or more or singularly provided on a plan view.

In some embodiments, the display device further includes a timing controller configured to apply a control signal to the first data driver and the second data driver so that a data signal is sequentially applied according to an order in which the plurality of first data lines and the plurality of second data lines are arranged on a plan view.

Accordingly, a display device according to an exemplary embodiment of the present invention may improve an image quality defect and a phenomenon whereby a boundary line between display regions is visible.

DETAILED DESCRIPTION

Figure 1:
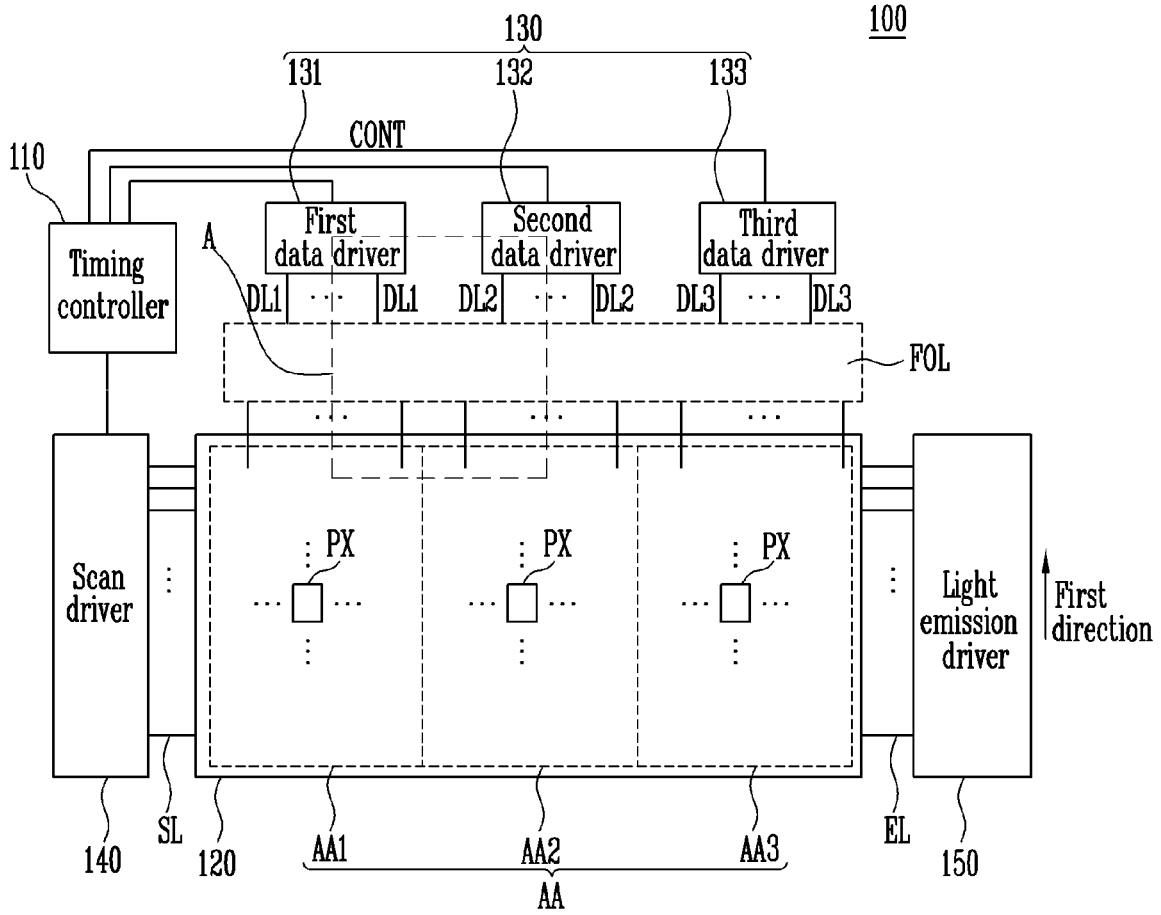
FIG. 1 is a schematic view of a display device according to an exemplary embodiment of the present invention.

Aspects and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the scope of the present invention is defined by the claims and equivalents thereof.

The same reference numerals designate the same elements throughout the specification. In addition, in the following description of the present invention, a detailed description of related arts will be omitted when it is determined that the gist of the present invention may be unnecessarily obscured. In a case where the terms "include", "have", "is formed", and the like are used in this specification, other constituent elements may be added as long as "~only" is not used. When explaining the singular, unless explicitly described to the contrary, it may be interpreted as the plural meaning.

The same reference numerals designate the same elements throughout the specification.

Hereinafter, with reference to accompanying drawings, a preferred exemplary embodiment of the present invention will be described in more detail.

FIG. 1 is a schematic diagram of a display device 100 according to an exemplary embodiment of the present invention.

Referring to FIG. 1, a display device 100 may include a timing controller 110, a display panel 120, a data driver 130, a scan driver 140, and a light emission driver 150.

The timing controller 110 may generate a clock signal, a scan start signal, and the like and supply it to the scan driver 140 to fit specifications of the scan driver 140 based on received control signals. In addition, the timing controller 110 may supply grayscale values and control signals that are modified or maintained to fit the specifications of the data driver 130 based on the received grayscale values and control signals to the data driver 130.

The scan driver 140 may receive control signals such as a clock signal, a scan start signal, and the like from the timing controller 110 and generate scan signals to be supplied to scan lines SL. The scan driver 140 may supply the scan signals through the scan lines SL, thereby selecting the pixels PX to which the data voltages are to be written. For example, the scan driver 140 may sequentially supply scan signals of a turn-on level to the scan lines SL, thereby selecting a pixel row to which the data voltages are to be written. The scan driver 140 may be formed as a shift register, and may generate the scan signals by sequentially transmitting a scan start signal to a next stage circuit according to a control of a clock signal. In addition, stage circuits of the scan driver 140 may concurrently (e.g., simultaneously) supply scan signals of the turn-on level to the corresponding scan lines SL according to a global control signal.

The light emission driver 150 may receive a clock signal, a light emitting stop signal, and the like from the timing controller 110 to generate light emitting signals to be provided to the light emitting lines EL. For example, the light emission driver 150 may sequentially provide light emitting signals having a turn-off level pulse on light emitting lines EL. For example, the light emission driver 150 may be formed as a shift register, and may generate the light emitting signals by sequentially transmitting a light emitting stop signal, which is a turn-off level pulse type, to a next stage circuit according to a control of a clock signal.

The display panel 120 includes a plurality of pixels PX and can display an image. Each pixel PX may be connected to corresponding data lines DL1, DL2, and DL3, and a scan line SL. For example, when the data voltages for one pixel PX row are applied to the data lines DL1, DL2, and DL3 from the data driver 130, the data voltages may be written to the pixel row disposed on the scan line SL receiving the scan signal of a turn-on level from the scan driver 140.

The data driver 130 may generate data voltages supplied to the data lines DL1, DL2, and DL3 using grayscale values (or data) and control signals received from the timing controller 110. For example, the data voltages generated by a pixel row unit may be applied to the data lines DL1, DL2, and DL3 concurrently (e.g., simultaneously). The data driver 130 may be formed as a plurality of data drivers. For example, the data driver 130 may include first to third data drivers 131, 132, and 133. Each data driver 130 may receive a control signal from the timing controller 110 to generate a data signal. The data driver 130 may be not limited to including first to third data drivers 131, 132, and 133, and may include two data drivers 130 or four or more data drivers 130.

The display region AA may be divided into first to third display regions AA1 to AA3. The first to third display regions AA1 to AA3 extend in a first direction and may be disposed side by side in order. In each display region AA, a plurality of pixels PX may be disposed in a matrix form. First data lines of the data lines DL1, DL2, and DL3 may be connected to the pixels PX disposed in the first display region AA1, second data lines of the data lines DL1, DL2, and DL3 may be connected to the pixels PX disposed in the second display region AA2, and third data lines of the data lines DL1, DL2, and DL3 may be connected to the pixels PX disposed in the third display region AA3. The display region AA is not limited to including the first to third display region AA1 to AA3, and may include two or four or more display regions AA). The number of display regions AA may correspond to the number of data drivers included in the data driver 130. For example, when the data driver 130 is formed of four data drivers, the display region AA may be divided into four display regions AA corresponding to the four data drivers.

A plurality of data lines disposed into the display region AA may be connected to the data driver 130 through a plurality of fan-out lines FOL. A connection structure of the plurality of fan-out lines FOL, the plurality of data lines, and the plurality of data drivers 130 will be described in more detail with reference to FIGS. 2 to 5.

Figure 2:
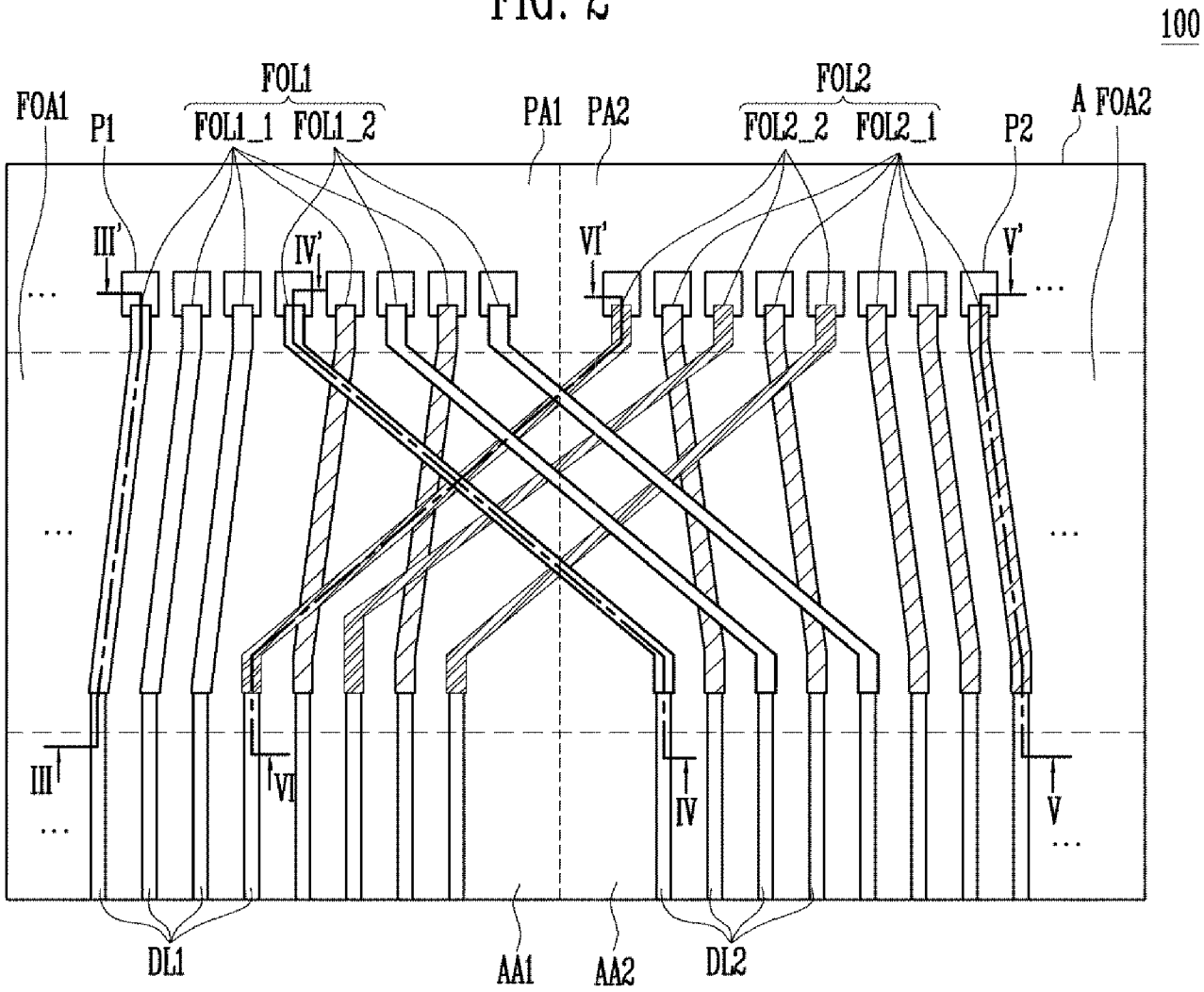
FIG. 2 is an enlarged plan view of the region A of FIG. 1.
Figure 3:
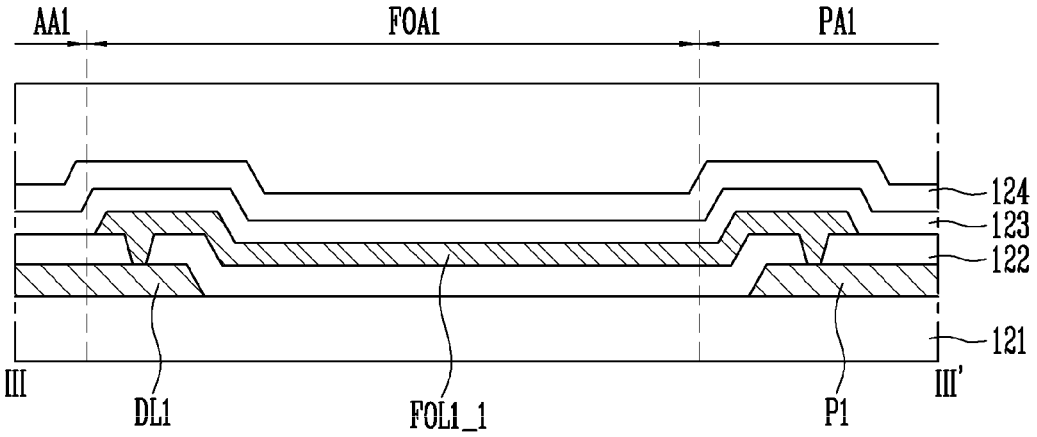
FIG. 3 is a cross-sectional view taken along the line III-III' of FIG. 2.
Figure 4:
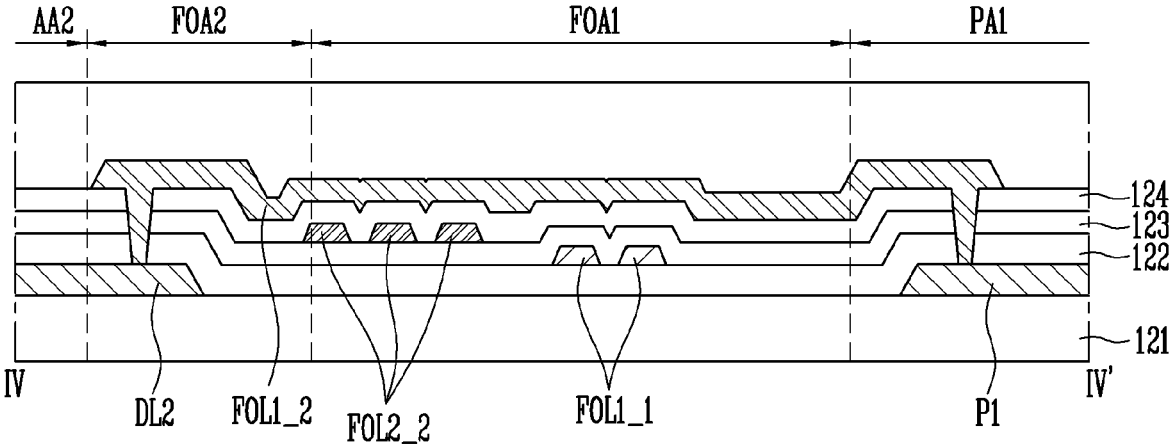
FIG. 4 is a cross-sectional view taken along the line IV-IV' of FIG. 2.
Figure 5:
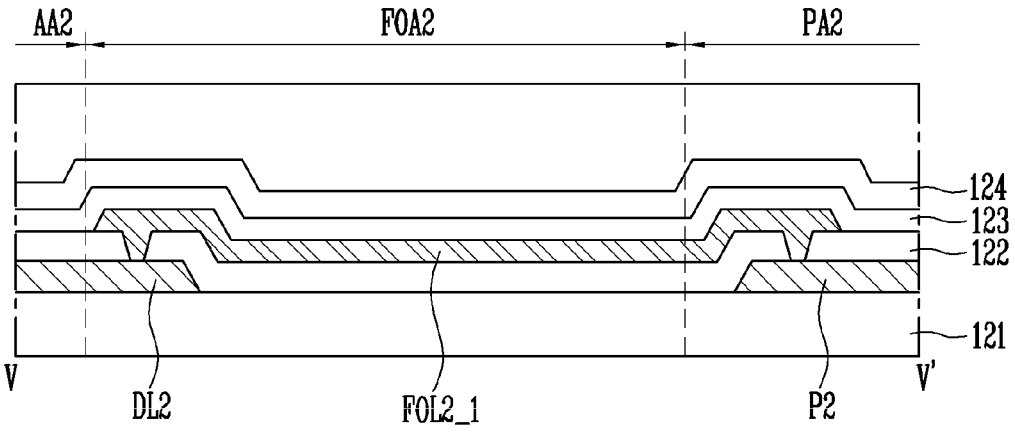
FIG. 5 is a cross-sectional view taken along the line V-V of FIG. 2.
Figure 6:
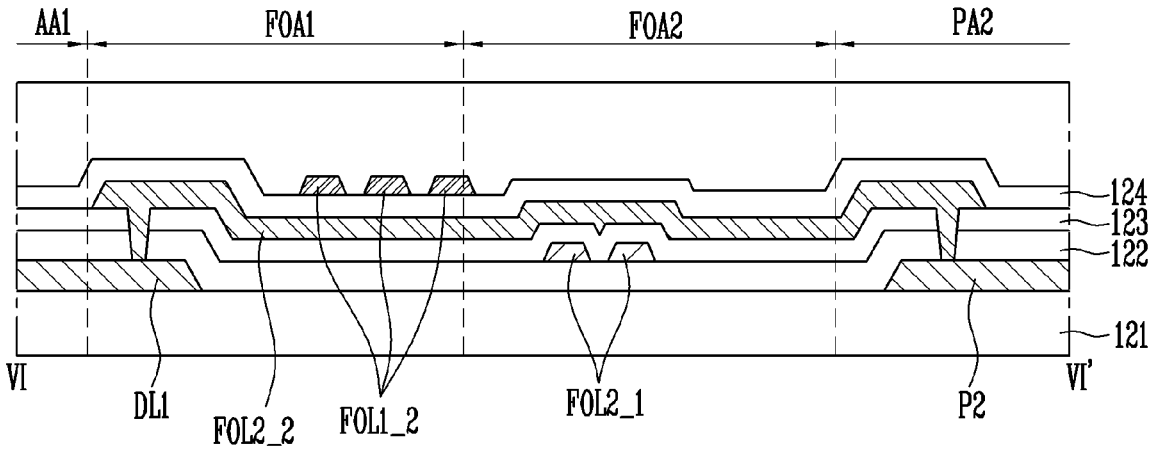
FIG. 6 is a cross-sectional view taken along the line VI-VI' of FIG. 2.

FIG. 2 is an enlarged plan view for the region A of FIG. 1. FIG. 3 is a cross-sectional view taken along the line III-III' of FIG. 2. FIG. 4 is a cross-sectional view taken along the line IV-IV' of FIG. 2. FIG. 5 is a cross-sectional view taken along the line V-V' of FIG. 2. FIG. 6 is a cross-sectional view taken along the line VI-VI' of FIG. 2.

Referring to FIGS. 2 to 6, a plurality of pads are disposed on pad regions PA1 and PA2. The pads are terminals that connect the fan-out lines FOL (e.g., FOL1 and FOL2) and the data driver 130. In some examples, the display device 100 includes a substrate 121 that is a base member for supporting various constituent elements of the display device 100, and a plurality of pads PA1 and PA2 may be disposed on the substrate 121. For example, in a first pad region PA1, a plurality of first pads P1 are disposed on the substrate 121, and the first data driver 131 may be disposed on the plurality of first pads P1. In a second pad region PA2, a plurality of second pads P2 are disposed on the substrate 121, and the second data driver 132 may be disposed on the plurality of second pads P2. Likewise, a plurality of third pads may be disposed on a third pad region adjacent to the second pad region PA2, and the third data driver 133 may be disposed on the plurality of third pads.

A plurality of fan-out lines FOL are disposed on a fan-out region FOA1 and FOA2. The fan-out regions FOA1 and FOA2 are regions where the plurality of fan-out lines FOL are disposed. The fan-out regions FOA1 and FOA2 may be disposed between the pad regions PA1 and PA2, where the data driver 130 is disposed, and the display region AA. A first fan-out region FOA1 of the fan-out regions FOA1 and FOA2 is a region disposed between the first pad region PA1, where the first data driver 131 is disposed, and the first display region AA1, and a second fan-out region FOA2 of the fan-out regions FOA1 and FOA2 is a region disposed between the second pad region PA2, where the second data driver 132 is disposed, and the second display region AA2. Similarly, a third fan-out region may be disposed between the third pad region, where the third data driver 133 is disposed, and the third display region AA3.

A plurality of first fan-out lines FOL1 of the plurality of fan-out lines FOL may be the fan-out line FOL connected to the plurality of first pad P1. One end of each of the first fan-out lines FOL1 is connected to a corresponding one of the first pads P1 and extends to the first fan-out region FOA1.

The plurality of first fan-out lines FOL1 includes a plurality of 1_1-th fan-out lines FOL1_1 and a plurality of 1_2-th fan-out lines FOL1_2. The 1_1-th fan-out lines FOL1_1 are fan-out lines FOL that connect the first pad P1 and the first data line DL1. Referring to FIG. 3, the first data line DL1 is formed on the substrate 121 of the first display region AA1 and extends to a portion of the first fan-out region FOA1. A first insulation layer 122 is formed on the first data line DL1, the substrate 121, and the first pad P1, and the 1_1-th fan-out line FOL1_1 is formed on the first insulation layer 122. The first insulation layer 122 is an insulation layer that insulates lines disposed on an upper portion and a lower portion of the first insulation layer 122 from each other. One end of the 1_1-th fan-out line FOL1_1 is connected to the first pad P1 through contact holes formed in the first insulation layer 122 and the other end thereof is connected to the first data line DL1. Accordingly, the first pad P1 and the first data line DL1 may be electrically connected through the 1_1-th fan-out line FOL1_1, and the first data driver 131 connected to the first pad P1 may transmit the data signal to the first data line DL1 through the 1_1-th fan-out line FOL1_1. The data signal transmitted from the first data driver 131 through the 1_1-th fan-out line FOL1_1 and the first data line DL1 may be transmitted to the pixels PX disposed in the first display region AA1.

The 1_2-th fan-out lines FOL1_2 are fan-out lines FOL that connects the first pad P1 and the second data line DL2. Referring to FIG. 4, the second data line DL2 is formed on the substrate 121 of the second display region AA2 and extends to a portion of the second fan-out region FOA2. The first insulation layer 122, a second insulation layer 123, and a third insulation layer 124 are sequentially stacked on the second data line DL2, the substrate 121, and the first pad P1, and the 1_2-th fan-out line FOL1_2 is formed on the third insulation layer 124. Each of the second insulation layer 123 and the third insulation layer 124 is an insulation layer that insulates lines disposed on an upper portion and a lower portion thereof. One end of the 1_2-th fan-out line FOL1_2 is connected to the first pad P1 through contact holes formed in the first insulation layer 122, the second insulation layer 123, and the third insulation layer 124, and the other end thereof is connected to the second data line DL2. For example, the 1_2-th fan-out line FOL1_2 may be connected to the first pad P1 in the first pad region PA1 and may extend to the first fan-out region FOA1 and the second fan-out region FOA2. The first pad P1 and the second data line DL2 may be electrically connected through the 1_2-th fan-out line FOL1_2, and the first data driver 131 connected to the first pad P1 may transmit the data signal to the second data line DL2 through the 1_2-th fan-out line FOL1_2. The data signal transmitted from the first data driver 131 through the 1_2-th fan-out line FOL1_2 and the second data line DL2 may be transmitted to pixels PX disposed in the second display region AA2.

The 1_2-th fan-out lines FOL1_2 may be alongside (e.g., be adjacent to) a boundary line between the first fan-out region FOA1 and the second fan-out region FOA2. That is, some first fan-out lines FOL1 alongside (e.g., adjacent to) the boundary line between the first fan-out region FOA1 and the second fan-out region FOA2 of the first fan-out lines FOL1 may be the 1_2-th fan-out lines FOL1_2, and other first fan-out lines FOL1 spaced apart from the boundary line of the first fan-out lines FOL1 may be the 1_1-th fan-out lines FOL1_1. A density of the 1_2-th fan-out line FOL1_2 may be higher in the region near (e.g., adjacent to) the boundary line between the first fan-out region FOA1 and the second fan-out region FOA2, and the density of the 1_2-th fan-out line FOL1_2 may be lower in the region far from the boundary line. As shown in FIG. 2, for example, only the first, third, and fifth first fan-out lines FOL1 from the boundary line between the first fan-out region FOA1 and the second fan-out region FOA2 of the first fan-out line FOL1 may be the 1_2-th fan-out lines FOL1_2. These 1_2-th fan-out lines FOL1_2 may be connected to each of the first, third, and fifth first pads P1 from the boundary line of the first pad region PA1 and the second pad region PA2 of the first pads P1. Thus, the 1_2-th fan-out lines FOL1_2 may be disposed alternately with the 1_2-th fan-out lines FOL1_2 crossing the boundary line between the first fan-out region FOA1 and the second fan-out region FOA2. In addition, the first pads P1 connected to the 1_2-th fan-out line FOL1_2 may be alternately disposed with the first pads P1 connected to the 1_1-th fan-out lines FOL1_1 alongside (e.g., adjacent to) the boundary line between the first pad region PA1 and the second pad region PA2.

In addition, the data line DL connected to the 1_2-th fan-out lines FOL1_2 of the second data lines DL2 disposed in the second display region AA2 may be disposed alongside (e.g., adjacent to) the boundary line between the first display region AA1 and the second display region AA2. That is, the density of the second data line DL2 connected to the 1_2-th fan-out line FOL1_2 may be higher in the region near (e.g., adjacent to) the boundary line between the first display region AA1 and the second display region AA2, and the density of the second data lines DL2 that are not connected to the 1_2-th fan-out lines FOL1_2 may be higher as the distance from the boundary line increases. As shown in FIG. 2, for example, only the first, third, and fifth second data lines DL2 from the boundary line between the first display region AA1 and the second display region AA2 of the second data line DL2 may be connected to the 1_2-th fan-out line FOL1_2. Thus, the second data lines DL2 connected to the 1_2-th fan-out line FOL1_2 may be (e.g., may only be) odd-numbered (or even-numbered) second data lines DL2 alongside (e.g., adjacent to) the boundary line.

In FIG. 2, the number of the 1_2-th fan-out lines FOL1_2 crossing the boundary line between the first fan-out region FOA1 and the second fan-out region FOA2 is shown as three lines, but the present invention is not limited to thereto, and more than one 1_2-th fan-out line FOL1_2 may be disposed if desired.

A plurality of second fan-out lines FOL2 of the plurality of fan-out lines FOL may be a fan-out line FOL connected to the plurality of second pad P2. One end of the second fan-out lines FOL2 is connected to each of the second pads P2 once and extends to the second fan-out region FOA2.

A plurality of the second fan-out line FOL2 includes a plurality of 2_1-th fan-out line FOL2_1 and a plurality of 2_2-th fan-out line FOL2_2. The 2_1-th fan-out line FOL2_1 are fan-out lines FOL that connects the second pad P2 and the second data line DL2. The 2_1-th fan-out line FOL2_1 are the fan-out lines FOL that connects the second pad P2 and the second data line DL2. Referring to FIG. 5, the second data line DL2 is formed on the substrate 121 of the second display region AA2 and extends to a portion of the second fan-out region FOA2. The first insulation layer 122 is formed on the second data line DL2, the substrate 121 and the second pad P2, and the 2_1-th fan-out line FOL2_1 is formed on the second insulation layer 122. One end of the 2_1-th fan-out line FOL2_1 is connected to the second pad P2 through contact holes formed in the first insulation layer 122, and the other end thereof is connected to the second data line DL2. Therefore, the second pad P2 and the second data line DL2 may be electrically connected through the 2_1-th fan-out line FOL2_1, and the second data driver 132 connected to the second pad P2 may transmit the data signal to the second data line DL2 through the 2_1-th fan-out line FOL2_1. The data signal transmitted from the second data driver 132 through the 2_1-th fan-out line FOL2_1 and the second data line DL2 may be transmitted to the pixels PX disposed in the second display region AA2.

The 2_2-th fan-out lines FOL2_2 are fan-out lines FOL that connects the second pad P2 and the first data line DL1. Referring to FIG. 6, the first insulation layer 122, the second insulation layer 123, and the third insulation layer 124 are sequentially stacked on the first data line DL1, the substrate 121, and the second pad P2, and the 2_2-th fan-out line FOL2_2 is formed between the second insulation layer 123 and the third insulation layer 124. One end of the 2_2-th fan-out line FOL2_2 is connected to the second pad P2 through contact holes formed in the first insulation layer 122 and the second insulation layer 123, and the other end thereof is connected to the first data line DL1. For example, the 2_2-th fan-out lines FOL2_2 may be connected to the second pads P2 in the second pad region PA2 and may extend to the second fan-out region FOA2 and the first fan-out region FOA1. The second data driver 132 connected to the second pad P2 may transmit the data signal to the first data line DL1 through the 2_2-th fan-out line FOL2_2. The data signal transmitted from the second data driver 132 through the 2_2-th fan-out line FOL2_2 and the first data line DL1 may be transmitted to the pixels PX disposed in the first display region AA1.

The 2_2-th fan-out line FOL2_2 may be disposed alongside (e.g., adjacent to) the boundary line between the first fan-out region FOA1 and the second fan-out region FOA2. That is, some second fan-out lines FOL2 alongside (e.g., adjacent to) the boundary line between the first fan-out region FOA1 and the second fan-out region FOA2 of the second fan-out lines FOL2 may be the 2_2-th fan-out lines FOL2_2, and other second fan-out lines FOL2 spaced apart from the boundary line of the second fan-out lines FOL2 may be the 2_1-th fan-out lines FOL2_1. The density of the 2_2-th fan-out line FOL2_2 may be higher in the region adjacent to the boundary line between the first fan-out region FOA1 and the second fan-out region FOA2, and the density of the 2_2-th fan-out line FOL2_2 may be lower as the distance from the boundary line increases. As shown in FIG. 2, for example, only the first, third, and fifth second fan-out line FOL2 alongside (e.g., adjacent to) the boundary line of the second fan-out lines FOL2 may be the 2_2-th fan-out lines FOL2_2. These 2_2-th fan-out lines FOL2_2 may be connected to each of the first, third, and fifth second pads P2 from the boundary line between the first pad region PA1 and the second pad region PA2 of the second pads P2. The 2_2-th fan-out lines FOL2_2 may be disposed alternately with the 2_1-th fan-out lines FOL2_1 crossing the boundary line between the first fan-out region FOA1 and the second fan-out region FOA2. In addition, the second pads P2 connected to the 2_2-th fan-out line FOL2_2 may be alternately disposed with the second pads P2 connected to the 2_1-th fan-out lines FOL2_1 crossing the boundary line between the first pad region PA1 and the second pad region PA2.

In addition, the data line DL connected to the 2_2-th fan-out lines FOL2_2 of the first data lines DL1 disposed in the first display region AA1 may be disposed alongside (e.g., adjacent to) the boundary line between the first display region AA1 and the second display region AA2. That is, the density of the first data line DL1 connected to the 2_2-th fan-out line FOL2_2 may be higher in the region adjacent to the boundary line between the first display region AA1 and the second display region AA2, and the density of the first data lines DL1 that are not connected to the 2_2-th fan-out lines FOL2_2 may be higher as the distance from the boundary line increases. As shown in FIG. 2, for example, only the first, third, and fifth data line DL1 nearest to (e.g., adjacent to) the boundary line between the first display region AA1 and the second display region AA2 of the first data lines DL1 may be connected to the 2_2-th fan-out line FOL2_2. Thus, the second data lines DL2 connected to the 2_2-th fan-out line FOL2_2 may be (e.g., may only be) odd-numbered (or even-numbered) second data lines DL2 nearest to (e.g., adjacent to) the boundary line.

In FIG. 2, the number of the 2_2-th fan-out lines FOL2_2 crossing the boundary line between the first fan-out region FOA1 and the second fan-out region FOA2 is shown as three lines, but the present invention is not limited to thereto, and more than one 2_2-th fan-out line FOL2_2 may be disposed if desired.

A plurality of fan-out lines FOL may be overlapped and crossed with an insulation layer interposed therebetween in the fan-out regions FOA1 and FOA2. The first fan-out lines FOL1 may be overlapped and crossed with an insulation layer interposed therebetween in the first fan-out region FOA1.

For example, referring to FIGS. 2 and 4, the 1_2-th fan-out lines FOL1_2 and the 1_1-th fan-out line FOL1_1 may be overlapped and crossed with the second insulation layer 123 and the third insulation layer 124 interposed therebetween in the first fan-out region FOA1, and thus the 1_2-th fan-out lines FOL1_2 may be electrically insulated with the 1_1-th fan-out line FOL1_1.

Referring to FIGS. 2 and 6, the 2_2-th fan-out lines FOL2_2 and the 1_1-th fan-out line FOL2_1 may be overlapped and crossed with the second insulation layer 123 interposed therebetween in the second fan-out region FOA2, and thus the 2_2-th fan-out lines FOL2_2 may be electrically insulated with the 2_1-th fan-out line FOL2_1.

The 1_2-th fan-out line FOL1_2 and the 2_2-th fan-out line FOL2_2 may be overlapped and crossed with the insulation layer interposed therebetween in the region alongside (e.g., adjacent to) the boundary line between the first fan-out region FOA1 and the second fan-out region FOA2. Referring to FIGS. 2, 4, and 6, the 1_2-th fan-out line FOL1_2 and the 2_2-th fan-out line FOL2_2 may be overlapped and crossed with the third insulation layer 124 interposed therebetween between the first fan-out region FOA1 and the second fan-out region FOA2. Thus, the 1_2-th fan-out line FOL1_2 and the 2_2-th fan-out line FOL2_2 may be electrically insulated.

The timing controller 110 may apply the control signal CONT to each of the first data driver 131 and the second data driver 132 to sequentially apply the data signal according to an arrangement order of the plurality of first data lines DL1 and the plurality of second data lines DL2. The first data driver 131 does not sequentially apply the data signal according to a connection order of the first fan-out line FOL1, and the second data driver 132 does not sequentially apply the data signal according to a connection order of the second fan-out line FOL2. The first data driver 131 and the second data driver 132 may apply the data signals to the first fan-out line FOL1 and second fan-out line FOL2 so that the data signals may be sequentially applied to the plurality of first data lines DL1 according to the arrangement order on a plan view and then the data signals may be sequentially applied to the plurality of second data lines DL2 according to the arrangement order on a plan view.

In a case of a conventional display device, the fan-out lines connected to one of the plurality of data drivers are connected only to a data line disposed in one display region, and the fan-out lines connected to the other data driver adjacent to the corresponding data driver are connected only to the data lines disposed in other display region adjacent to the one display region. An image quality defect may occur due to the difference in the charging rate of the data drivers at the boundary line between the adjacent display regions, and thus, a problem may occur such that the boundary line between the display regions is visible.

On the other hand, in the display device 100 according to an exemplary embodiment of the present invention, the 1_1-th fan-out line FOL1_1, which is one of the first fan-out lines FOL1 connected to the first data driver 131, is connected to the first data line DL1, and the 1_2-th fan-out line FOL1_2, which is another one of the first fan-out lines FOL1, is connected to the second data line DL2. In addition, the 2_1-th fan-out line FOL2_1, which is one of the second fan-out line FOL2 connected to the second data driver 132, is connected to the second data line DL2, and the 2_2-th fan-out line FOL2_2, which is another one of the second fan-out lines FOL2, is connected to the first data line DL1. In addition, the 1_2-th fan-out line FOL1_2 and the 2_2-th fan-out line FOL2_2 are disposed in the region adjacent to the boundary line between the first fan-out region FOA1 and the second fan-out region FOA2, and the second data lines DL2 connected to the 1_2-th fan-out line FOL1_2 and the first data lines DL1 connected to the 2_2-th fan-out line FOL2_2 are disposed alongside (e.g., adjacent to) and crossing the boundary line between the first display region AA1 and the second display region AA2. The fan-out lines FOL connected to each of these two adjacent data drivers 130 may be crossed and connected to the data lines DL. Accordingly, data lines DL disposed alongside (e.g., adjacent to) the boundary line between two adjacent display regions AA may alternately receive data signals applied from different data drivers 130. Therefore, the image quality defect due to the difference in the charging rate of the data drivers 130 at the boundary line between two adjacent display regions AA may be reduced, and the problem of visibility of the boundary line between the two display regions AA may be improved.

Figure 7:
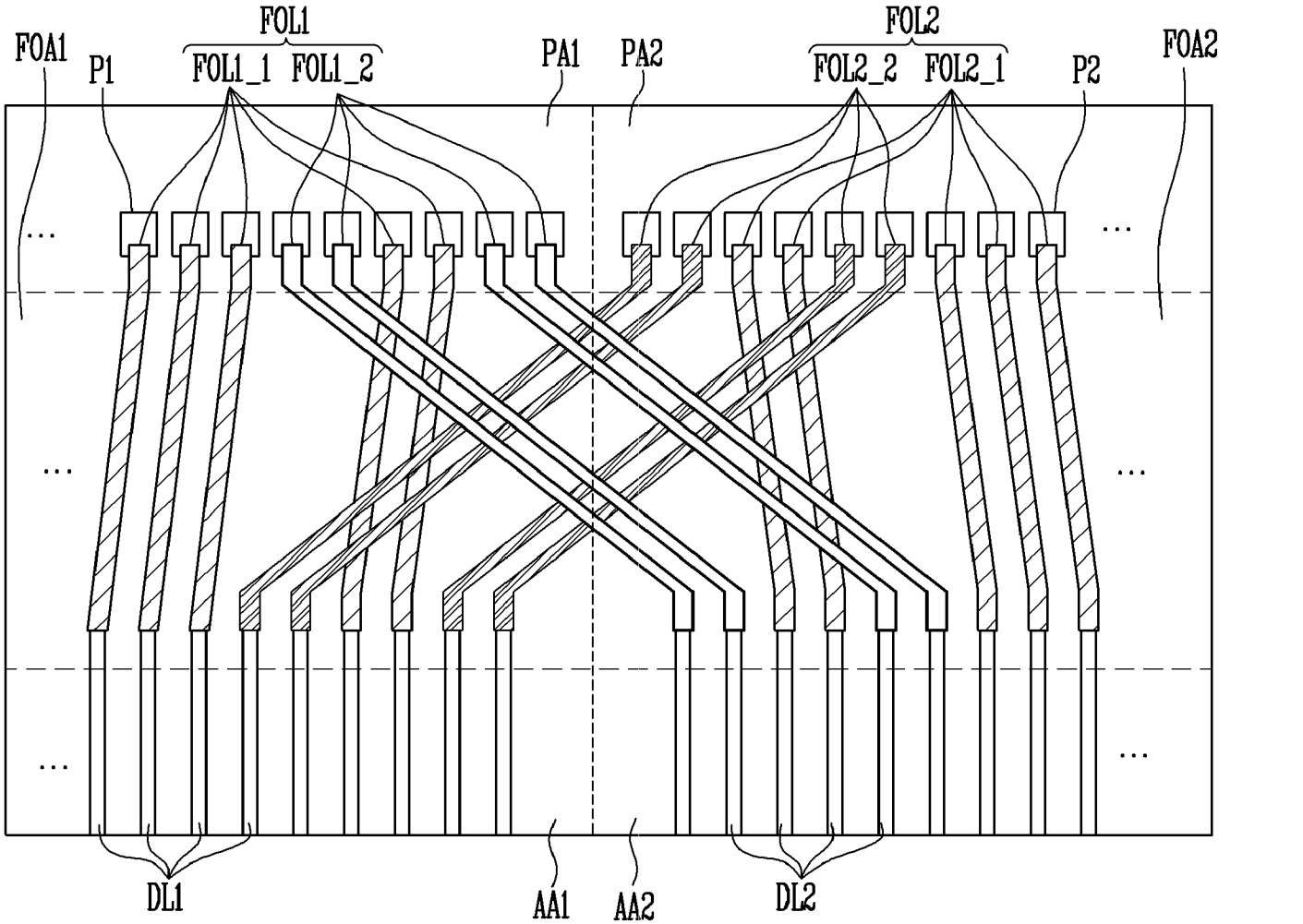
FIG. 7 is an enlarged plan view of a display device according to another exemplary embodiment of the present invention.

FIG. 7 is an enlarged plan view of a display device according to another exemplary embodiment of the present invention. Since the display device 700 of FIG. 7 is substantially the same as the display device 100 of FIGS. 1 to 6 except that the first fan-out line FOL1 and the second fan-out line FOL2 are differently disposed, duplicate descriptions may not be repeated.

Referring to FIG. 7, the 1_2-th fan-out line FOL1_2 of the first fan-out line FOL1 may be disposed adjacent to each other by two. For example, first and second fan-out lines FOL and fifth and sixth fan-out lines FOL from the boundary line between the first fan-out region FOA1 and the second fan-out region FOA2 of the first fan-out line FOL1 may be the 1_2-th fan-out line FOL1_2. In addition, the 1_1-th fan-out line FOL1_1 disposed between the 1_2-th fan-out lines FOL1_2 may be disposed adjacent to each other in pairs of two. That is, the third and fourth fan-out lines FOL from the boundary line between the first fan-out region FOA1 and the second fan-out region FOA2 of the first fan-out line FOL1 may be the 1_1-th fan-out line FOL1_1.

Similarly, the 2_2-th fan-out line FOL2_2 of the second fan-out line FOL2 may be disposed parallel adjacent (e.g., in parallel and adjacent) to each other in pairs of two, and the 2_1-th fan-out line FOL2_1 may be disposed parallel adjacent to each other in pairs of two between the 2_2-th fan-out lines FOL2_2.

However, the present invention is not limited thereto, and the 1_1-th fan-out line FOL1_1, the 1_2-th fan-out line FOL1_2, the 2_1-th fan-out line FOL2_1 and the 2_2-th fan-out line FOL2_2 may be disposed adjacent to each other in groups of two or more or may be singularly provided (i.e., a single 1_1-th fan-out line FOL1_1 may be adjacent to a 1_2-th fan-out line FOL1_2 on both sides, and vice versa). In addition, the number of 1_2-th fan-out lines FOL1_2 disposed parallel adjacent to each other may be different from and the number of 1_1-th fan-out lines FOL1_1 disposed parallel adjacent to each other, and the number of 2_1-th fan-out lines FOL2_1 disposed parallel adjacent to each other may be different from the number of 2_2-th fan-out lines FOL2_2 disposed parallel adjacent to each other. For example, the 1_2-th fan-out lines FOL1_2 may be disposed parallel adjacent to each other in pairs of two, and the 1-1-th fan-out line FOL1_1 may be singularly provided between the 1_2-th fan-out lines FOL1_2.

In a display device 700 according to another embodiment of the present invention, the 1_2-th fan-out lines FOL1_2 may be disposed parallel adjacent to each other in groups of two or more or be singularly provided, and the 1_1-th fan-out lines FOL1_1 may be disposed parallel adjacent to each other in groups of two or more or be singularly provided. The fan-out lines FOL connected to each of these two adjacent data drivers 130 may be crossed and connected to the data lines DL. Accordingly, data lines DL disposed near (e.g., adjacent to) the boundary line between two adjacent display regions AA may alternately receive data signals applied from different data drivers 130. Therefore, the image quality defect due to the difference in the charging rate of the data drivers 130 at the boundary line between two adjacent display regions AA may be reduced, and the problem of visibility of the boundary line between the two display regions AA may be improved.

Figure 8:
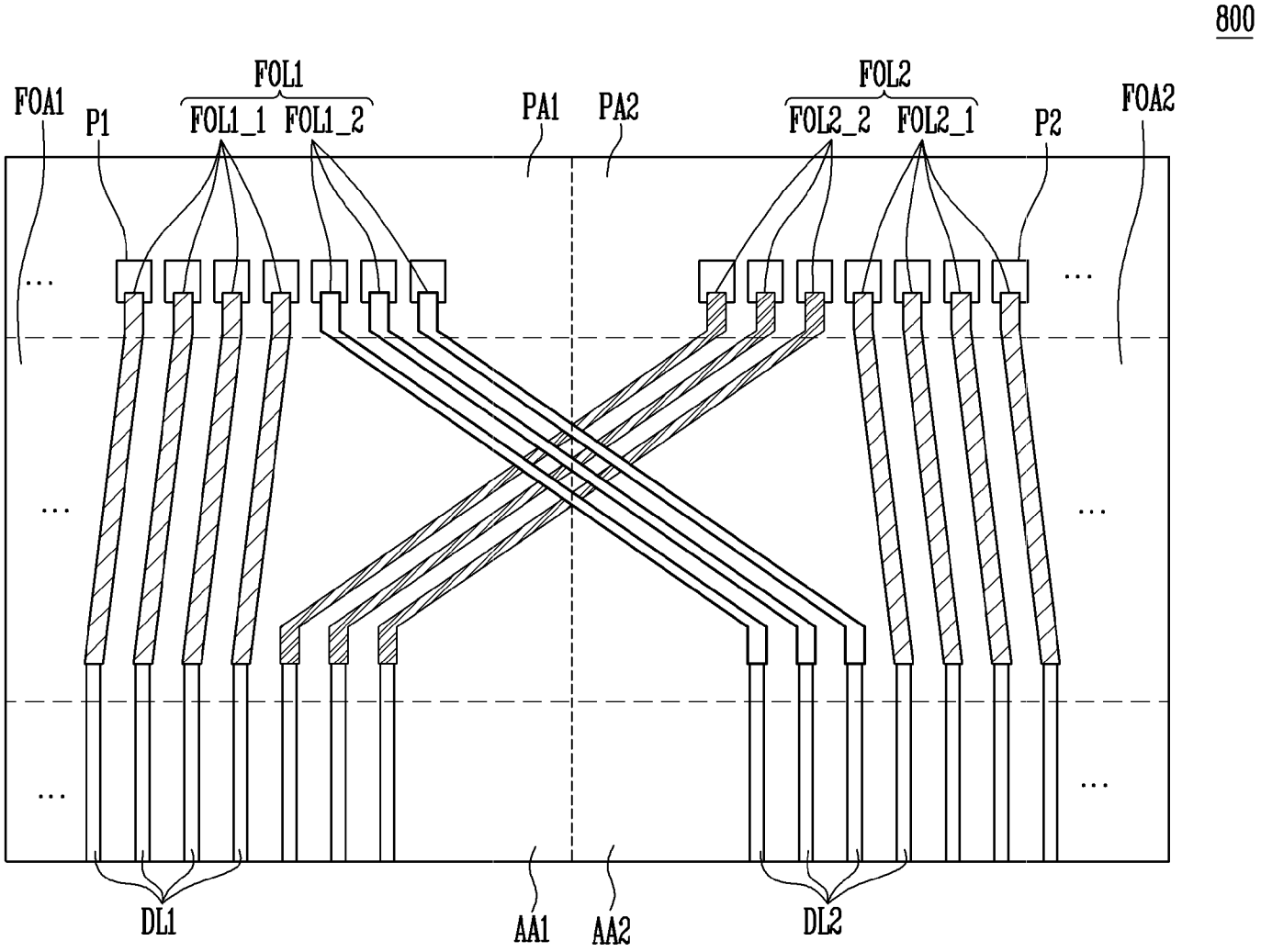
FIG. 8 is an enlarged plan view of a display device according to another exemplary embodiment of the present invention.

FIG. 8 is an enlarged plan view of a display device according to another exemplary embodiment of the present invention. Since the display device 800 of FIG. 8 is substantially the same as the display device 100 of FIGS. 1 to 6 except that the first fan-out line FOL1 and the second fan-out line FOL2 are differently disposed, duplicate descriptions may not be repeated.

Referring to FIG. 8, the 1_2-th fan-out line FOL1_2 of the first fan-out line FOL1 may be disposed nearest to the boundary line between the first fan-out region FOA1 and the second fan-out region FOA2, and all the fan-out lines FOL may be disposed parallel adjacent to each other. For example, the 1_2-th fan-out line FOL1_2 may be first to fourth fan-out lines FOL from the boundary line between the first fan-out region FOA1 and the second fan-out region FOA2 of the first fan-out line FOL1. In addition, the 2_2-th fan-out line FOL2_2 of the second fan-out line FOL2 may be disposed nearest to the boundary line, and all the fan-out line FOL may be disposed parallel adjacent to each other. For example, the 2_2-th fan-out line FOL2_2 may be first to fourth fan-out lines FOL from the boundary line between the first fan-out region FOA1 and the second fan-out region FOA2 of the first fan-out line FOL1. However, the number of 1_2-th fan-out lines FOL1_2 and 2_2-th fan-out lines FOL2_2, which are all disposed parallel adjacent to each other, is not limited to four, but may be one or more.

In a display device 800 according to another exemplary embodiment of the present invention, fan-out lines FOL alongside (e.g., adjacent to) the boundary line between the display regions AA of the fan-out lines FOL may be crossed and connected to different data driver 130. Accordingly, data lines DL disposed alongside (e.g., adjacent to) the boundary line between two adjacent display regions AA may alternately receive data signals applied from different data drivers 130. Therefore, the image quality defect due to the difference in the charging rate of the data drivers 130 at the boundary line between two adjacent display regions AA may be reduced, and the problem of visibility of the boundary line between the two display regions AA may be improved.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the terms "use," "using," and "used" may be considered synonymous with the terms "utilize," "utilizing," and "utilized," respectively.

The display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

The above-detailed description illustrates and explains the present invention. In addition, the above-detailed description merely illustrates exemplary embodiments of the present invention, the present invention may be used in various other combinations, changes, and environments as described above, and the scope of the inventive concepts disclosed herein may be changed or modified within the scope of equivalents and/or techniques or knowledge in the art. Therefore, the above-detailed description is not intended to limit the present invention to the disclosed embodiments. In addition, the appended claims should be construed to include other embodiments.

What is claimed is:

1. A display device comprising:

a display panel comprising a first display region in which a plurality of first data lines are positioned and a second display region in which a plurality of second data lines are positioned, the second display region being adjacent to the first display region;

a first data driver and a second data driver in a non-display region of the display panel;

a plurality of first fan-out lines connected to the first data driver and comprising a plurality of 1_1-th fan-out lines connected to the plurality of first data lines and a plurality of 1_2-th fan-out lines connected to the plurality of second data lines; and a plurality of second fan-out lines connected to the second data driver and comprising a plurality of 2_1-th fan-out lines connected to the plurality of second data lines and a plurality of 2_2-th fan-out lines connected to the plurality of first data lines.

2. The display device of claim 1, wherein the non-display region comprises a first fan-out region between the first data driver and the first display region, and a second fan-out region between the second data driver and the second display region, wherein the plurality of 1_2-th fan-out lines are alongside a boundary line between the first fan-out region and the second fan-out region, and wherein the plurality of 2_2-th fan-out lines are alongside the boundary line.

3. The display device of claim 2, wherein the plurality of 1_2-th fan-out lines extend from the first fan-out region to the second fan-out region, and wherein the plurality of 2_2-th fan-out lines extend from the second fan-out region to the first fan-out region.

4. The display device of claim 3, wherein the plurality of 1_2-th fan-out lines are overlapped and crossed with some of the plurality of 1_1-th fan-out lines with an insulation layer interposed therebetween in the first fan-out region, and are overlapped and crossed with some of the plurality of 2_1-th fan-out lines with the insulation layer interposed therebetween in the second fan-out region, and wherein the plurality of 1_2-th fan-out lines are overlapped and crossed with some of the plurality of 2_1-th fan-out lines with the insulation layer interposed therebetween in the second fan-out region, and are overlapped and crossed with some of the plurality of 1_1-th fan-out lines with the insulation layer interposed therebetween in the first fan-out region.

5. The display device of claim 2, wherein the plurality of 1_2-th fan-out lines and the plurality of 2_2-th fan-out lines are alongside the boundary line between the first fan-out region and the second fan-out region and are overlapped and crossed with each other with an insulation layer interposed therebetween.

6. The display device of claim 2, wherein the plurality of 1_2-th fan-out lines are adjacent to each other in groups of two or more or singularly provided, and wherein the plurality of 2_2-th fan-out lines are adjacent to each other in groups of two or more or singularly provided.

7. The display device of claim 6, wherein the plurality of 1_2-th fan-out lines are even-numbered or odd-numbered lines of the plurality of first fan-out lines, and wherein the plurality of 2_2-th fan-out lines are even-numbered or odd-numbered lines of the plurality of second fan-out lines.

8. The display device of claim 2, wherein the plurality of 1_2-th fan-out lines are all adjacent to each other, and wherein the plurality of 2_2-th fan-out lines are all adjacent to each other.

9. The display device of claim 1, wherein the plurality of 1_1-th fan-out lines are on different layers with the plurality of 1_2-th fan-out lines, and wherein the plurality of 2_1-th fan-out lines are on different layers with the plurality of 2_2-th fan-out lines.

10. The display device of claim 1, wherein the second data lines connected to the plurality of 1_2-th fan-out lines and the first data lines connected to the plurality of 2_2-th fan-out lines are alongside a boundary line between the first display region and the second display region.

11. The display device of claim 10, wherein the first data lines, except for ones of the first data lines adjacent to the boundary line of the plurality of first data lines, are connected only to the plurality of 1_1-th fan-out lines and not the plurality of 2_2-th fan-out lines, and wherein the second data lines, except for ones of the second data lines adjacent to the boundary line of the plurality of second data lines, are connected only to the plurality of 2_1-th fan-out lines and not the plurality of 1_2-th fan-out lines.

12. The display device of claim 10, wherein ones of the second data lines connected to the plurality of 1_2-th fan-out lines are odd-numbered or even-numbered lines of the plurality of second data lines, and wherein ones of the first data lines connected to the plurality of 2_2-th fan-out lines are odd-numbered or even-numbered lines of the plurality of first data lines.

13. The display device of claim 12, wherein the ones of the second data lines connected to the plurality of 1_2-th fan-out lines and the ones of the second data lines connected to the plurality of 2_1-th fan-out lines are alternately arranged in groups of two or more or singularly provided on a plan view, and wherein the ones of the first data lines connected to the plurality of 2_2-th fan-out lines and the ones of the first data lines connected to the plurality of 1_1-th fan-out lines are alternatively arranged in groups of two or more or singularly provided on a plan view.

14. The display device of claim 1, further comprising:

a timing controller configured to apply a control signal to the first data driver and the second data driver so that a data signal is sequentially applied according to an order in which the plurality of first data lines and the plurality of second data lines are arranged on a plan view.

* * * * *